United States Patent [19]

Muchmore et al.

[11] 4,441,886

[45] Apr. 10, 1984

[54] PROCESS FOR REMOVING ORGANIC SULPHUR FROM COAL AND MATERIAL RESULTING FROM THE PROCESS

[75] Inventors: Charles B. Muchmore, Carbondale; Juh W. Chen, Murphysboro; Kenneth E. Tempelmeyer, Carbondale, all of Ill.

[73] Assignee: Southern Illinois University Foundation, Carbondale, Ill.

[21] Appl. No.: 443,544

[22] Filed: Nov. 22, 1982

[51] Int. Cl.[3] ..... C10L 9/02; C10L 9/08

[52] U.S. Cl. ..... 44/15 R; 423/461

[58] Field of Search ..... 44/1 SR; 201/17; 423/460, 461

[56] References Cited

U.S. PATENT DOCUMENTS 3,660,054 5/1972 Rieve ..... 44/1 SR 4,192,651 3/1980 Keller ..... 44/1 SR

*Primary Examiner*—Carl F. Dees

*Attorney, Agent, or Firm*—Anthony S. Zummer

[57] ABSTRACT

The present invention relates to a process for removing organic sulphur from coal and the material resulting from the treatment of organic sulphur containing coal with the instant process. The subject process includes the step of mixing coal with ethyl alcohol having less than 4% water. The temperature and pressure of the coal and ethyl alcohol mixture is raised to above the critical temperature and pressure of ethyl alcohol. The coal ethyl alcohol mixture is held at moderate temperature and elevated pressure for a period of about 30 minutes or more. The liquid and solids are separated. The resulting coal solids have substantially less organic sulphur contained therein.

20 Claims, 1 Drawing Figure

PROCESS FOR REMOVING ORGANIC SULPHUR FROM COAL AND MATERIAL RESULTING FROM THE PROCESS

BACKGROUND OF THE INVENTION

Sulphur is included in many coals which makes those coals undesirable for use without expensive and efficiency reducing equipment to recover the products of sulphur combustion. One of the products of combustion of sulphur containing coals is sulphur dioxide, which is considered to be a highly undesirable pollutant of the atmosphere. It is generally recognized that sulphur in coal is present in a variety of forms. There are three basic forms, namely; pyritic sulphur, a sulphate, and organic sulphur. The pyritic sulphur is sulphur combined with iron. The sulphate sulphur is generally of a minute quantity, that is, it usually constitutes 1% or 2% of all the sulphur in a given coal specimen. Organic sulphur is sulphur which is combined in an organic compound with the carbon of the coal.

Organic sulphur is generally found to be difficult to remove from coal in that organic sulphur and compounds of coal are not well-defined. The problem which confronts most investigators is how to remove organic sulphur from coal. U.S. Letters Pat. No. 4,233,034 issued Nov. 11, 1980, to Miller et al. entitled "Desulfurization of Coal". The Miller et al patent discloses a process for removing sulphur from coal. The process taught in the Miller et al patent does not distinguish between the removal of organic sulphur from the removal of pyritic sulphur, but the teaching is simply directed to a process of removing sulphur without distinction of what type of sulphur is removed. It is known to remove pyritic sulphur efficiently from coal. The problem revolves around removing the organic sulphur efficiently.

SUMMARY OF THE INVENTION

The present invention relates to an improved process for removing organic sulphur from coal. The process includes a plurality of steps. Coal containing organic sulphur is broken down into granules. The granules of coal may, but need not necessarily be treated to remove substantially all of the water contained in the coal so that the coal is dry. The dried coal is then mixed with a selected quantity of ethyl alcohol which contains less than 4% water. The quantity of ethyl alcohol is such in each instance that the coal ethyl alcohol mixture contains less 61.7% solids by weight. The mixture of coal and ethyl alcohol is placed in a reaction vessel, and temperature and pressure in the vessel are raised above the critical temperature and pressure of ethyl alcohol. The mixture is maintained at a temperature and pressure above the critical temperature and pressure for a period of time. Any gas generated is collected and the coal solids of the mixture are separated from the liquid.

DESCRIPTION OF THE PREFERRED EMBODIMENTS

Figure 1:
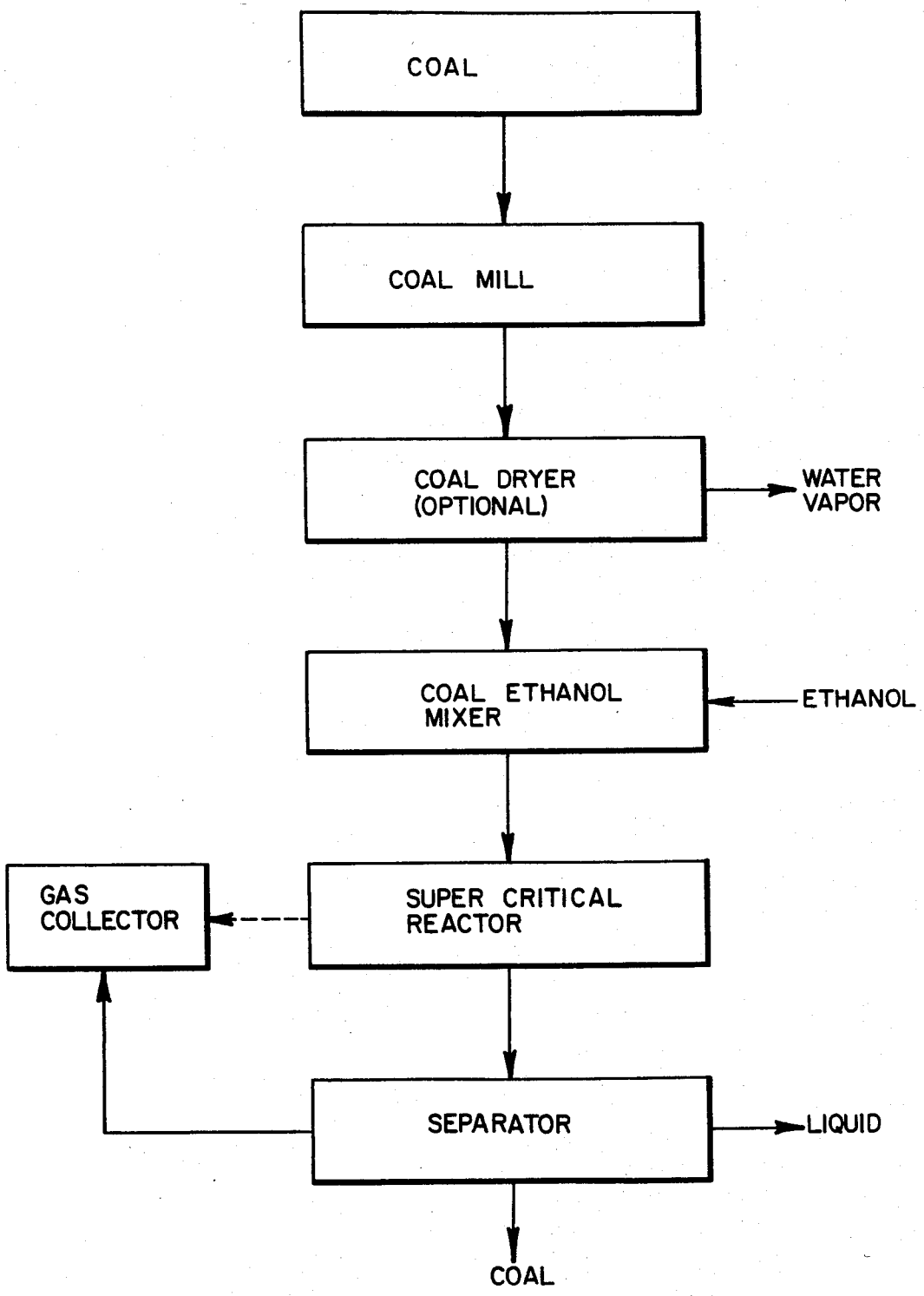
FIG. 1 is a process chart showing the flow of materials wherein coal is treated with ethyl alcohol to remove organic sulphur from the coal.

The subject process is used successfully in the removal of organic sulphur from coal. By the utilization of substantially anhydrous ethanol (ethyl alcohol) or ethanol containing up to 4% water, the reduction of concentration of sulphur in coal may be anywhere from 16.7% to 37.7%. The particular organic sulphur containing coal used in the following examples is Illinois No. 6 coal. However, other coals containing organic sulphur also may be treated. As is set forth in selected subsequent examples, pyritic sulphur may be first removed from the coal using a known process before the coal is treated with the instant process to remove the organic sulphur from the coal.

The organic sulphur containing coal is first ground into a granular form utilizing a conventional grinding mill. The desired standard mesh size is less than −40 standard mesh, although coal granules between −8 standard mesh and +10 standard mesh have been successfully processed.

The coal granulates may, but need not necessarily, have water removed from them by heating the coal to a temperature above the boiling point of water. A temperature of 103° C. is satisfactory. The water is removed by placing pans of the coal granules in an oven for 24 hours while the temperature of the oven is held above the boiling point of water for the entire period.

An anhydrous ethanol, or wet ethanol having an amount of water less than 4%, is mixed with the dried coal in a conventional pressure reactor having a built-in stirrer. The ethanol/coal mass ratio is in the range of ½ to 3.5/1. The tank has a vapor transfer line that is connected to a conventional condenser with a liquid receiver and a conventional gas collecting tank.

The ethanol coal mixture is heated in the reactor to a super critical temperature of the ethanol between 243.5° C. and 370° C. The heating of the mixture causes the pressure in the reactor to raise, and the pressure is allowed to rise to above the critical pressure of ethanol, to 927 psia but under 4200 psia. While the mixture is being heated, it is stirred. The temperature and pressure are maintained above the critical temperature and pressure of ethanol for a period of time in order to complete the reaction. After the reaction is completed, the gas generated in the reaction is collected.

The liquid is separated from the solids by atmospheric and/or vacuum distillation. As was mentioned above, the reduction in sulphur ranges from 16.7% to 37.7%. An examination of the liquid by means of a mass spectroscope shows that the liquid contains a variety of organic sulphur compounds. Among the compounds noted are: ethyl sulfide, ethyl disulfide, thiacetal, and thiophene. The results of mass spectroscopy examination shows that the organic sulphur contained in the coal reacts with the ethanol. The sulphur in the organic compounds in the coal reacts with the ethanol to form new compounds with the ethanol which new compounds are removed from the coal with the ethanol during the separation of the liquids from the solids.

Other solvents, namely, methanol, isopropanol and toluene, have been processed in the herein disclosed reaction system under comparable conditions of temperature and pressure. Generally, reduction in sulphur concentration in reactions utilizing these solvents rather than ethanol is less than 14%.

From the foregoing, it is readily apparent that the subject process may be utilized to remove organic sulphur from coal and thereby may achieve, sometimes in conjunction with conventional physical processes for removal of pyritic sulphur, a sufficient reduction of sulphur in coal to make it acceptable for ordinary industrial usage. The by-products of the process are important in that the gas produced is collected and has other uses, such as, driving auxiliary turbines or heating. The ethanol with the various organic compounds contained therein then may be distilled to recover the organic compounds which have a commercial value, and the ethanol then may be placed back into the cycle for removal of sulphur from coal.

The following examples are specific examples of utilization of the instant process. In order to demonstrate the efficacy of the subject process for the removal of organic sulphur, the coal used in Examples 1 and 2 was first treated with a wellknown process used for the removal of pyritic sulphur. In the remaining examples, the coal was not so treated.

The following Table I shows the percentage of various types of sulphur in the coal which was contained in the coal prior to treatment by the subject process as is set forth for the following examples.

TABLE I

Sulphur Analysis of Coal Treated By The Subject Process In Examples 1 Through 8

| Example Number | 1 and 2 | 3 Through 8 |
|---|---|---|
| Sulphate Sulphur, % Sulphur | 0.24 | 0.15 |
| Pyritic Sulphur, % Sulphur | 0.43 | 1.07 |
| Organic Sulphur, % Sulphur | 2.67 | 1.57 |

The coal used in each of the following examples was Illinois No. 6 coal. Prior to introduction of the coal into the subject process in Examples 1 and 2, the coal was treated by a well-known process to remove the pyritic sulphur. As is evident from an inspection of Table I above, more than one-half of the pyritic sulphur was removed from the coal before the coal was treated by the herein disclosed process in Examples 1 and 2. The pyritic sulphur was not removed from the coal prior to treatment of the coal by the subject process in Examples 3 through 8.

Each of the examples of the subject process is set forth in detail herein as follows:

EXAMPLE 1

The coal treated was Illinois No. 6 coal having a particle size between −40 standard mesh and +100 standard mesh. The coal had been treated previously to remove from the coal a substantial portion of the pyritic sulphur. The coal was oven dried at 103° C. for 24 hours to remove substantially all of the moisture from the coal. 0.9 kg of the dried coal particles were mixed with 0.45 kg of anhydrous ethanol in a 25.4 cm diameter ball mill for 8 hours to produce a stable suspension. Anhydrous alcohol was added to the suspension of coal and ethanol to adjust the percentage of solids to 58.9%. To a conventional 300 cc stirred pressure autoclave, equipped with an external electric heater and internal cooling coil were added 130.6 gm of the coal/ethanol suspension.

Following pressurization with nitrogen to 1500 psig and subsequent venting of the nitrogen to atmospheric pressure through previously nitrogen purged gas transfer lines and condenser system, the transfer line valve was closed and heating of the stirred reactor contents commenced. As heating proceeded at a rate of about 6.5C/min, pressure increased in the reactor, closely following the vapor pressure curve of ethyl alcohol. As critical conditions (Temperature=243.5° C., Pressure=927 psia) were approached, volatilization of coal components and/or decomposition of ethanol to gaseous products caused the pressure to increase to 1725 psig. Cessation of the heat input occurred 4 minutes after reaching critical conditions. After 26 minutes above critical conditions, the temperature dropped below critical; cooling water was applied 18 minutes later. The maximum temperature was 287° C., the maximum pressure was 1725 psig. When ambient temperature was attained, the residual pressure was 220 psig. Venting of the gaseous product through the condenser and gas sampling and collection system resulted in 2.48 l of gas collected at ambient temperature and pressure.

Heat was again applied to the reactor, vaporizing volatile materials at atmospheric pressure and collecting same through the condenser and gas collection system. Liquid recovery was 47.6 gm (density=0.851 gm/cc).

The run was terminated at 360° C. at which time negligible liquid flows were observed from the condenser. Cooling water was again applied. After attaining room temperature, the reactor system was disassembled for product analysis. Product yields and analyses are given in Table II.

EXAMPLE 2

To a 300 cc stirred pressure autoclave, equipped with an external electric heater and internal cooling coil, were added 126.4 gm of a coal/ethanol suspension containing 55.6% solids and prepared by ball milling as described in Example 1. Following pressurization with nitrogen to 1500 psig and subsequent venting of the nitrogen to atmospheric pressure through previously nitrogen purged gas transfer lines and condenser system, the transfer line valve was closed and heating of the stirred reactor contents commenced. As heating proceeded at a rate of about 5° C./min, pressure increased in the reactor, closely following the vapor pressure curve of ethyl alcohol. As critical conditions were approached (Temperature=243.5° C., Pressure=927 psia), volatilization of coal components and/or decomposition of ethanol to gaseous products caused the pressure to increase to 3025 psig. Cessation of the heat input caused a drop in temperature to 200° C. The temperature was below critical temperature for 19 minutes of the 34 minute total initial reaction period. The maximum temperature was 262° C., the maximum pressure was 3025 psig. Following this first stage reaction, cooling water was passed through the internal cooling coil of the reactor. When ambient temperature was attained, the residual pressure was 750 psig. Venting of the gaseous product through the condenser and gas sampling and collection system resulted in 6.42 l of gas collected at ambient temperature and pressure.

Closing of the vent valve and cessation of the cooling water flow was followed by heat up for a second stage reaction, allowing 40 minute reaction time, 15 minutes of which supercritical conditions were attained. An additional 12.07 l of gaseous product at ambient temperature and pressure was obtained. During the 48 minute period while gas was collected, cooling water was applied and the temperature dropped from 192° C. to 94° C.

Heat was again applied to the reactor, vaporizing volatile materials at atmospheric pressure and collecting same through the condenser and gas collection system. Liquid recovery was 11.0 gm (density=1.06 gm/cc).

The run was terminated at 323° C. at which time negligible liquid flows were observed from the condenser. Cooling water was again applied. After attaining room temperature, the reactor system was disassembled for product analysis. Product yields and analyses are given in Table II.

The following table sets forth in tabular form the results of the foregoing examples:

TABLE II

| Example No. | 1 | 2 |
|---|---|---|
| Coal Charged gm | 77.0 | 70.3 |
| Ethanol Charged gm | 53.6 | 56.1 |
| Product Recoveries and Characteristics | | |
| Solids, gm | 63.2 | 58.0 |
| Solids, Recovery % | 82.1 | 82.5 |
| Sulphur, % | 2.55 | 2.08 |
| Btu/lb | 13,339 | 13,486 |
| Ash, % | 5.33 | 6.96 |
| Liquids, gm | 47.6 | 11.0 |
| Liquid recovery, % | 88.8 | 19.6 |
| Gas, Liters | 2.5 | 21.5 |
| Concentration of Reduction of Sulphur, % | 23.6 | 37.7 |

The two foregoing examples demonstrate the efficacy of the instant process in reducing the amount of organic sulphur in the coal since a substantial portion of the pyritic sulphur had been removed by a well-known process. The succeeding Examples 3 through 6 demonstrate the effectiveness of the present process in removing organic sulphur from coal which had not been treated to remove any pyritic sulphur in the coal.

EXAMPLE 3

To a 300 cc stirred pressure autoclave, equipped with an external electric heater and internal cooling coil, were added 71.5 gm of oven dried (103° C., for 24 hr) Illinois No. 6 coal of particle size between −40 standard mesh and +100 standard mesh and 71.5 gm anhydrous ethyl alcohol. Following pressurization with nitrogen to 1500 psig and subsequent venting of the nitrogen to atmospheric pressure through previously nitrogen purged gas transfer lines and condenser system, the transfer line valve was closed and heating of the stirred reactor contents commenced. As heating proceeded at a rate of about 4° C./min, pressure increased in the reactor, closely following the vapor pressure curve of ethyl alcohol. As critical conditions (Temperature=243.5° C., Pressure=927 psia), were approached, volatilization of coal components and/or decomposition of ethanol to gaseous products caused the pressure to increase to 1000 psig. Reduction of the heat input caused a drop in temperature slightly below critical conditions for about 40 minutes of the 100 minute total initial reaction period. The maximum temperature was 288° C., the maximum pressure was 1350 psig. Following this first stage reaction, cooling water was passed through an internal cooling coil of the reactor, resulting in a temperature decrease to 65° C. over a 75 minute period, at which time the pressure reduced to 200 psig. Venting of the gaseous product through the condenser and gas sampling and collection system resulted in 3.4 l of gas being collected at ambient temperature and pressure.

Closing of the vent valve and cessation of the cooling water flow was followed by heat-up of the contents of the autoclave for a second stage reaction, again allowing a 50 minute reaction time at supercritical conditions prior to cool down and collection of 2.25 l additional gaseous product at ambient temperature and pressure.

Heat was again applied to the reactor, vaporizing volatile materials at atmospheric pressure and collecting same through the condenser and gas collection system. Liquid recovery was 56.5 gm (density=.818 gm/cc).

The run was terminated at 285° C. at which time negligible liquid flows were observed from the condenser. Cooling water was again applied; after attaining room temperature the reactor system was disassembled for collection of solids. Product yields and analyses are given in Table III following these examples.

EXAMPLE 4

One kilogram of oven dried (103° C., for 24 hr) Illinois No. 6 coal of particle size between −40 standard mesh and +100 standard mesh and 0.5 kg anhydrous ethanol were mixed in a 25.4 cm diameter ball mill for 8 hrs. to produce a stable suspension. Anhydrous ethanol was added to give a solids content of 61.7%. 96.5 gm of the coal ethanol mixture were processed in the manner given in Example 3 except that gaseous and some liquid products were collected starting immediately after supercritical conditions were attained, by semi-continuous venting through the condenser and gas collection system, without cool down of the reactor. The pressure was maintained between 927 psig and 1700 psig.

After 170 minutes, at a temperature of 301° C. and when negligible liquid product was observed from the condenser, the reactor was cooled to room temperature.

Product yields and analyses are given in Table III.

EXAMPLE 5

Seventy gm oven dried (103° C., for 24 hr) Illinois No. 6 coal (granular size between −40 standard mesh and +100 standard mesh) and 70 gm anhydrous ethanol were processed in the manner given in Example 3, except that some gaseous and liquid products were collected after a 30 minute reaction period at supercritical conditions. Maximum temperature was 257° C. and maximum pressure was 1850 psig. After collecting 1.0 l of gas at ambient temperature and pressure, the pressure fell from 1850 psig to 1520 psig. The vent valve was closed and cooling water applied to reduce the temperature to 60° C. An additional 4.1 l of gas at ambient temperature and pressure were collected followed by heating to supercritical conditions for the second stage reaction. An additional 30 minutes reaction period at supercritical conditions occurred, Maximum temperature was 270° C. and maximum pressure was 1800 psig. Gas and liquid product was again collected, maintaining heat input and without cooling water. When the temperature reached 270° C. and negligible liquid product was observed at the condenser, cooling water was applied. After cooling to room temperature, solids were recovered from the reactor and solid, liquid and gaseous products were analyzed. The results are set forth in Table III.

EXAMPLE 6

To a 300 cc stirred pressure autoclave, equipped with an external electric heater and internal cooling coil, were added 20 gm of oven dried (103° C., for 24 hr) Illinois No. 6 coal of particle size between −40 standard mesh and +100 standard mesh and 70 gm anhydrous ethyl alcohol. Following pressurization with nitrogen to 600 psig and subsequent venting of the nitrogen to atmospheric pressure through a previously nitrogen purged gas transfer lines and condenser system, the transfer line valve was closed and heating of the stirred reactor contents commenced. As heating proceeded at a rate of about 4° C./min, pressure increased in the reactor, closely following the vapor pressure curve of ethyl alcohol. As critical conditions (Temperature=243.5° C., Pressure=927 psia) were approached, volatilization of coal components and/or decomposition of ethanol to gaseous products caused the pressure to increase to 1550 psig. Critical conditions were maintained for 30 minutes. The maximum temperature was 290° C., the maximum pressure was 1550 psig. Following this first stage reaction, cooling water was passed through the internal cooling coil of the reactor, resulting in a temperature decrease to 51° C. over a 40 minute period, at which time the pressure dropped to slightly above atmospheric pressure. Venting of the gaseous product through the condenser and gas sampling and collection system resulted in 0.3 l of gas being collected at ambient temperature and pressure.

Closing of the vent valve and cessation of the cooling water flow was followed by heat up for a second stage reaction, again following a 30 minute reaction time at supercritical conditions prior to cool down and collection of 0.4 l additional gaseous product at ambient temperature and pressure. Maximum temperature was 301° C. and maximum pressure was 1780 psig during this stage.

Heat was again applied to the reactor, vaporizing volatile materials at atmospheric pressure and collecting same through the condenser and gas collection system. Liquid recovery was 62.9 gm (density=0.796 gm/cc).

The run was terminated at 260° C. at which time negligible liquid flows were observed from the condenser. Cooling water was again applied; after attaining room temperature, the reactor system was disassembled for product analysis. Product yields and analyses are given in Table III.

EXAMPLE 7

To a 300 cc stirred pressure autoclave, equipped with an external electric heater and internal cooling coil, were added 70 gm of oven dried (103° C., for 24 hr) Illinois No. 6 coal of particle size between −40 standard mesh and +100 standard mesh and 70 gm anhydrous ethyl alcohol. Following pressurization with nitrogen to 600 psig and subsequent venting of the nitrogen to atmospheric pressure through a previously nitrogen purged gas transfer line and condenser system, the transfer line valve was closed and heating of the stirred reactor contents commenced. As heating proceeded at a rate of about 5° C./min, pressure increased in the reactor, closely following the vapor pressure curve of ethyl alcohol. As critical conditions (Temperature 243.5° C., Pressure=927 psia) were approached, reduction of the heat input caused the temperature to level off at about 238° C. The maximum pressure was 800 psig. Following a 60 minute reaction time below supercritical conditions, venting of the gaseous product through the condenser and gas sampling and collection system resulted in 1.62 l of gas collected at ambient temperature and pressure.

Heat was again applied to the reactor, vaporizing volatile materials at atmospheric pressure and collecting same through the condenser and gas collection system. Liquid recovery was 64.5 gm (density=0.796 gm/cc). The run was terminated at 320° C. at which time negligible liquid flows were observed from the condenser. Cooling water was again applied. After attaining room temperature, the reactor system was disassembled for product analysis. Product yields and analyses are given in Table III.

EXAMPLE 8

To a 300 cc stirred pressure autoclave, equipped with an external electric heater and internal cooling coil, were added 35 gm of oven dried (103° C., for 24 hr) Illinois No. 6 coal of particle size between −8 standard mesh and +10 standard mesh and 70 gm anhydrous ethyl alcohol. Following pressurization with nitrogen to 1500 psig and subsequent venting of the nitrogen to atmospheric pressure through previously nitrogen purged gas transfer lines and condenser system, the transfer line valve was closed and heating of the stirred reactor contents commenced. As heating proceeded at a rate of about 5° C./min, pressure increased in the reactor, closely following the vapor pressure curve of ethyl alcohol. As critical conditions (Temperature=243.5° C., Pressure 927 psia) were approached, volatilization of coal components and/or decomposition of ethanol to gaseous products caused the pressure to increase to 1450 psig. Reduction of the heat input caused the temperature to level off at about 274° C. The maximum pressure was 1450 psig. Following a 30 minute reaction time above supercritical conditions, cooling water was passed through the internal cooling coil of the reactor resulting in a temperature decrease to 58° C. over a 25 minute period, at which time the pressure reduced to 0 psig. Venting of the gaseous product through the condenser and gas sampling and collection system resulted in no gas collected.

Closing of the vent valve and cessation of the cooling water flow was followed by heat up for a second stage reaction, again allowing a 30 minute reaction time at supercritical conditions prior to cool down and collection of 1.73 l gaseous product at ambient temperature and pressure. Maximum pressure was 1500 psig; maximum temperature was 272° C.

Closing of the vent valve and cessation of the cooling water flow was followed by heat-up for a third stage reaction, again allowing a 50 minute reaction time at supercritical conditions prior to cool down and collection of 2.25 l additional gaseous product at ambient temperature and pressure.

Heat was again applied to the reactor, vaporizing volatile materials at atmospheric pressure and collecting same through the condenser and gas collection system. Liquid recovery was 37.5 gm.

The run was terminated at 270° C. at which time negligible liquid flows were observed from the condenser. Cooling water was again applied. After attaining room temperature, the reactor system was disassembled for product analysis. Product yields and analyses are given in Table III.

Material input and material output are set forth in the following Table III. The table also sets forth an analysis of the treated solids and the percentage reduction of concentration of sulphur.

TABLE III

| Example No. | 3 | 4 | 5 | 6 | 7 | 8 |
|---|---|---|---|---|---|---|
| Coal Charged gm | 71.5 | 59.5 | 70 | 20 | 70 | 35 |

TABLE III-continued

| Example No. | 3 | 4 | 5 | 6 | 7 | 8 |
|---|---|---|---|---|---|---|
| Ethanol Charged gm | 71.5 | 37.0 | 70 | 70 | 70 | 70 |
| Sulphur is Coal Charged, % | 3.01 | 2.87 | 2.79 | 2.80 | 2.70 | 2.46 |
| Product Recoveries and Characteristics | | | | | | |
| Solids, gm | 65.8 | 46.0 | 60 | 19.8 | 66.9 | 30.5 |
| Solids, Recovery % | 92.0 | 77.3 | 85.7 | 99.0 | 95.6 | 87.1 |
| Sulphur, % | 2.23 | 2.03 | 2.18 | 2.21 | 2.42 | 2.05 |
| Btu/lb | 13,202 | 12,940 | 12,694 | 13,401 | 12,634 | 13,385 |
| Ash, % | 12.44 | 14.46 | 13.94 | 11.64 | 12.71 | 10.52 |
| Liquids, gm | 56.5 | 13.2 | 50.96 | 62.9 | 64.5 | 37.5 |
| Liquid recovery, % | 79.0 | 35.7 | 72.8 | 89.9 | 92.1 | 53.6 |
| Gas, Liters | 6.4 | 9.5 | 10.2 | 0.7 | 1.6 | 1.7 |
| Reduction of Concentration of Sulphur, % | 25.9 | 29.3 | 21.9 | 21.1 | 10.4 | 16.7 |

It may be seen from an examination of Tables II and III that the subject process is effective in removing organic sulphur from coal. When the temperature and pressure in the reaction vessel are not allowed to reach the critical temperature and pressure of ethanol (Temperature=243.5° C., Pressure=927 psia), the reduction of concentration of sulphur is less than half that attained when the temperature and pressure were held in the supercritical range. The reduction of concentration of sulphur in Example 7 was 10.3% while the reduction of concentration in sulphur in Examples 1 through 6 ranged from 21.1% to 37.7% thereby demonstrating the improved effectiveness of the subject process.

The particle size of the treated coal seems to have an effect on the operability of the instant process. In Example 8, the coal particles were of a particle size between −8 standard mesh and +10 standard mesh. The temperature and pressure attained in Example 8 were in the supercritical range for ethanol and the times for the application of the supercritical temperature and pressure were comparable to the times in Examples 1 through 6. However, in Examples 1 through 6, the particle size of the coal was between −40 standard mesh and +100 standard mesh. Since the percent reduction of concentration of sulphur in Example 8 was 16.7% while the percent reduction of concentration of sulphur in Examples 1 through 6 ranged from 21.1% to 37.7%, the utilization of the smaller particle size of coal appeared to be more effective in the removal of organic sulphur from the coal.

Based upon the observations made in the course of the preparation of the foregoing examples, it appears that the organic sulphur while under pressure and at the raised temperatures enters into a reaction with the ethanol. If the compounds of sulphur and ethanol are allowed to stay in contact with the coal at the raised temperatures and elevated pressures, there appears to be a rereaction of the sulphur in the new compounds with the coal to recreate organic sulphur containing coal. It is, therefore, advantageous either to remove the compounds resulting from the combination of sulphur with the ethanol, or in the alternative, to reduce the temperature and pressure so that there will be no reverse reaction. In those instances, where the product is a gaseous product, the material may be easily removed by removing the gas from the reaction. Cooling of the ethanol coal mixture tends to set the sulphur in the product resulting from the combination of the sulphur and the ethanol. It has been observed that in the production of gaseous materials, there is no significant amount of hydrogen sulphide produced in the reaction. It has also been observed that the range of percentage of solids in the initial ethanol coal mixture or suspension should be between 22% and 61.7% for an effective reaction.

Although specific examples have been shown and described in detail in the foregoing specification, it is readily apparent that those skilled in the art may make various modifications and changes without departing from the spirit and scope of the present invention. It is to be expressly understood that the instant invention is limited only by the appended claims.

What is claimed is:

1. A process for removing organic sulphur from coal comprising the steps of: mixing coal with ethanol, raising the temperature and pressure of the coal ethanol mixture to above the critical temperature and pressure of the ethanol, holding the coal ethanol mixture at the moderate temperature and elevated pressure for a period sufficient to allow the sulphur in the coal to react with the ethanol, and separating the resultant fluids from the coal solids.

2. A process for removing organic sulphur from coal as defined in claim 1, including the step of reducing the coal size to granules.

3. A process for removing organic sulphur from coal as defined in claim 1, including the step of reducing the size of the coal to granules having a size less than -10 standard mesh.

4. A process for removing organic sulphur from coal as defined in claim 1, including the step of removing water from the coal prior to mixing with ethanol by heating the coal to a temperature above the boiling point of water.

5. A process for removing organic sulphur from coal as defined in claim 1, wherein the mixture of coal and ethanol contains less than 61.7% solids by weight.

6. A process for removing organic sulphur from coal as defined in claim 1, wherein the mixture of coal and ethanol is heated to a temperature in excess of 243.5° C. for at least 30 minutes.

7. A process for removing organic sulphur from coal as defined in claim 1, wherein the mixture of coal and ethanol is heated in an oxygen-free atmosphere.

8. A process for removing organic sulphur from coal as defined in claim 1, wherein the mixture of coal and ethanol is placed under pressure in excess of 927 psia for at least 30 minutes in an oxygen-free atmosphere.

9. A process for removing organic sulphur from coal as defined in claim 1, wherein the mixture of coal and ethanol contains between 22% and 61.7% solids by weight.

10. A process for removing organic sulphur from coal as defined in claim 1, wherein the coal is dried prior to mixing with ethanol.

11. A process for removing organic sulphur from coal as defined in claim 1, wherein the coal is placed in suspension in the ethanol.

12. A process for removing organic sulphur from coal as defined in claim 1, including the step of reducing the coal size to granules, and wherein the coal granules are placed in suspension in the ethanol.

13. A process for removing organic sulphur from coal as defined in claim 1, including: reducing the size of the coal to granules having a size between −40 standard mesh and +100 standard mesh, heating the granules of coal to a temperature above the boiling point of water, and holding the granules of coal at the temperature above the boiling point of water until substantially all of the water is dried out of the coal.

14. A process for removing organic sulphur from coal as defined in claim 1, including: reducing the coal size to granules, heating the granules of coal to a temperature above the boiling point of water, and holding the granules of coal at the temperature above the boiling point of water until substantially all of the water is driven out of the coal granules, and wherein said mixture of coal and ethanol being less than 61.7% solids by weight, and the coal and ethanol mixture being held at the elevated temperature and pressure for at least 30 minutes in an oxygen-free atmosphere.

15. A process for removing organic sulphur from coal as defined in claim 1, including: reducing the coal size to granules having a size between −40 standard mesh and +100 standard mesh, heating the granules of coal to a temperature above the boiling point of water and holding the granules of coal at a temperature above the boiling point of water for 24 hours, and wherein said ethanol is substantially water-free, said mixture of coal and ethanol being less than 61.7% solids by weight, said coal ethanol mixture being raised to above the critical temperature and pressure of ethanol in an oxygen-free atmosphere, and said coal ethanol mixture is held at the raised temperature and pressure for at least 30 minutes in an oxygen-free atmosphere.

16. A solid coal product made in accordance with the process of claim 1.

17. A liquid product made in accordance with the process of claim 1.

18. A process for removing organic sulphur from coal comprising the steps of: reducing the coal to particles having a size between −10 standard mesh and +40 standard mesh, heating the coal particles to a temperature in excess of the boiling point of water, holding the coal particles at a temperature about the boiling point of water for a sufficient time period to drive off substantially all of the water from the coal particles, mixing the dry coal particles with anhydrous ethanol into a mixture of coal particles and ethanol having less than 61.7% solids, heating the mixture of coal particles and ethanol to a temperature between 262° C. and 370° C. at a pressure between 1,050 psia and 3,050 psia, holding the mixture of coal particles and ethanol at the raised temperature and pressure for at least 30 minutes, and separating the liquid from the solids.

19. A process for removing organic sulphur from coal comprising the steps of: reducing the coal to granules having a size between −10 and +100 standard mesh, heating the coal granules to a temperature in excess of the boiling point of water, holding the coal granules at a temperature above the boiling point of water to drive off substantially all of the water contained in the coal granules, mixing the dried coal granules with ethanol into a mixture of coal granules and ethanol having between 22% and 61.7% solids, heating the mixture of coal granules and ethanol to a temperature of at least 244° 0 C., applying a pressure to the mixture of coal granules and ethanol to in excess of 927 psia, cooling the mixture of coal granules and ethanol, and separating the resulting liquid from the remaining solids.

20. A solid coal product made in accordance with the process of claim 19.

* * * * *

UNITED STATES PATENT OFFICE

CERTIFICATE OF CORRECTION

PATENT NO. : 4,441,886

DATED : April 10, 1984

INVENTOR(S) : Muchmore et al.

It is certified that error appears in the above-identified patent and that said Letters Patent are hereby corrected as shown below:

Col. 1, Line 47, after "which", insert --ethyl alcohol--

Col. 12, Line 35, cancel --.0-- after "244°"

Signed and Sealed this

*Twenty-first* Day of *August 1984*

[SEAL]

*Attest:*

*Attesting Officer*

GERALD J. MOSSINGHOFF

*Commissioner of Patents and Trademarks*